US005525451A

United States Patent [19]

Ward et al.

[11] Patent Number: 5,525,451

[45] Date of Patent: Jun. 11, 1996

[54] PHOTORECEPTOR FABRICATION METHOD

[75] Inventors: Anthony T. Ward, Webster; Donald J. Teney, Rochester, both of N.Y.

[73] Assignee: Xerox Corporation, Stamford, Conn.

[21] Appl. No.: 454,460

[22] Filed: May 30, 1995

[51] Int. Cl.[6] ..... G03G 5/043

[52] U.S. Cl. ..... 430/132

[58] Field of Search ..... 430/132, 56, 57, 430/63, 69

[56] References Cited

U.S. PATENT DOCUMENTS

| | | | |
|---|---|---|---|
| 4,618,552 | 10/1986 | Tanaka et al. | 430/60 |
| 4,904,557 | 2/1990 | Kubo et al. | 430/56 |
| 5,069,758 | 12/1991 | Goodrow | 205/73 |
| 5,139,907 | 8/1992 | Simpson et al. | 430/58 |
| 5,382,486 | 1/1995 | Yu et al. | 430/56 |

*Primary Examiner*—John Goodrow
*Attorney, Agent, or Firm*—Zosan S. Soong

[57] ABSTRACT

There is disclosed a method for forming a photosensitive imaging member to be subjected to light of a specific wavelength comprising: depositing a charge generating layer on a substrate, depositing a charge transport layer on the charge generating layer, wherein there is variation in the thickness of the transport layer, and controlling during the deposition of the charge generating layer the thickness of the generating layer as a way to substantially suppress the optical interference effects at the wavelength of illumination due to the variation in the thickness of the transport layer, wherein the thickness of the generating layer is controlled to enable the imaging member to exhibit an optical absorption modulation which is effective for substantially suppressing the optical interference effects.

10 Claims, 3 Drawing Sheets

PHOTORECEPTOR FABRICATION METHOD

This invention relates to a method for suppressing optical interference effects occurring within a photosensitive member which degrade the quality of output prints derived from said exposed photosensitive member.

There are numerous applications in the electrophotographic art wherein a coherent beam of radiation, typically from a helium-neon or diode laser is modulated by an input image data signal. The modulated beam is directed (scanned) across the surface of a photosensitive medium. The medium can be, for example, a photoreceptor drum or belt in a xerographic printer or copier, a photosensor CCD array, or a photosensitive film. Certain classes of photosensitive medium which can be characterized as "layered photoreceptors" have at least a partially transparent photosensitive layer overlying a conductive ground plane (which is part of a substrate). A problem inherent in using these layered photoreceptors, depending upon the physical characteristics, is the creation of dominant reflections of the incident coherent light on the surface of the photoreceptor which can give rise to optical interference effects. This condition is shown in FIG. 1 where coherent beams 1 and 2 are incident on a layered photoreceptor 6 comprising a charge transport layer 7, charge generating layer 8, and a ground plane 9. When the difference in the optical indices (i.e., the refractive index and the absorption constant) of the charge transport layer 7 and the charge generating layer 8 is large, one dominant reflection is at the interface between the charge transport layer 7 and the charge generating layer 8. There is a second dominant from the top surface of layer 7. Depending on the optical path difference as determined by the thickness and index of refraction of layer 7, beams 1 and 2 can interfere constructively or destructively when they combine to form beam 3. When the additional optical path traveled by beam 1 (dashed rays) is an integer multiple of the wavelength of the light, constructive interference occurs, more light is reflected from the top of charge transport layer 7 and, hence, less light is absorbed by charge generating layer 8. Conversely, a path difference producing destructive interference means less light is lost out of the layer and more absorption occurs within the charge generating layer 8. The difference in absorption in the charge generating layer 8, typically due to layer thickness variations within the charge transport layer 7, is equivalent to a spatial variation in exposure on the surface. This spatial exposure variation present in the image formed on the photoreceptor becomes manifest in the output copy derived from the exposed photoreceptor. The pattern of light and dark interference fringes produced within a photoreceptor of the type shown in FIG. 1 when illuminated by for example a He—Ne laser with an output wavelength of 633 nm look like the grains on a sheet of plywood. Hence the term "plywood effect" is generically applied to this problem.

There is a need, which the present invention addresses, for minimizing or eliminating optical interference effects within a photosensitive imaging member of the type illustrated in for example FIG. 1.

The following disclosures may be relevant to various aspects of the present invention:

Tanaka et al., U.S. Pat. No. 4,618,552, discloses a photoconductive imaging member in which the ground plane, or an opaque conductive layer formed above the ground plane, is formed with a rough surface morphology to diffusely reflect the light, the disclosure of which is totally incorporated herein by reference.

Kubo et al., U.S. Pat. No. 4,904,557, discloses a photosensitive member comprised of a photosensitive layer on a conductive substrate having a smooth surface, wherein the photosensitive layer has a surface roughness, the disclosure of which is totally incorporated herein by reference.

Simpson et al., U.S. Pat. No. 5,139,907, discloses a layered photosensitive imaging member which is modified by forming a low-reflection layer on the ground plane, the disclosure of which is totally incorporated herein by reference.

SUMMARY OF THE INVENTION

The present invention involves a method for forming a photosensitive imaging member to be subjected to light of a specific wavelength comprising: depositing a charge generating layer on a substrate, depositing a charge transport layer on the charge generating layer, wherein there is variation in the thickness of the transport layer, and controlling during the deposition of the charge generating layer the thickness of the generating layer as a way to substantially suppress the optical interference effects at the wavelength of illumination due to the variation in the thickness of the transport layer, wherein the thickness of the generating layer is controlled to enable the imaging member to exhibit an optical absorption modulation which is effective for substantially suppressing the optical interference effects.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

Figure 1:
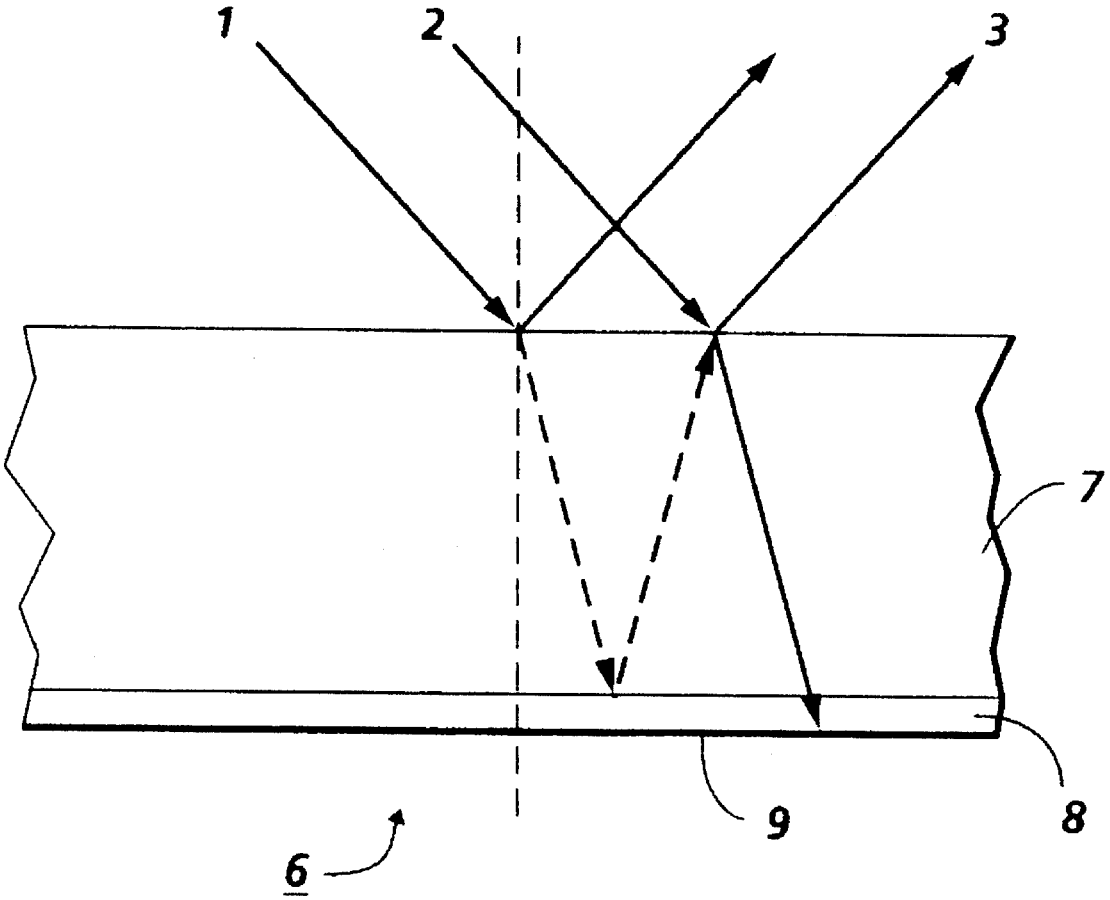
FIG. 1 PRIOR ART
FIG. 1 shows coherent light incident upon a prior art layered photosensitive imaging member leading to reflections internal to the member.

To determine a preferred thickness for the charge generating layer at the wavelength of illumination which substantially suppresses the optical interference effects within a photosensitive imaging member, the procedures similar to to those described in Example 1 herein are employed. In summary, for a particular photosensitive imaging member to be subjected to light of a specific wavelength, a computer simulation generates a number of lines plotted on a graph showing the variation in optical absorption of the imaging member at various thicknesses of the charge generating layer (referred herein as CGL") and the charge transport layer (referred herein as "CTL"). Since the CTL thickness may vary in an actual photoreceptor, it is advisable to simulate various CTL thicknesses wherein the CTL thickness varies by up to about 1 micron, and preferably up to 0.1 micron. The graph is analyzed to determine a CGL thickness where the optical absorption for all the lines representing the different CTL thicknesses are at a value or values which are effective for substantially suppressing the optical interference effects. The optical aborption may range for example from about 86% to 100%. At such a CGL thickness, the magnitude of the optical absorption modulation, i.e., the span of optical absorption values representing the different CTL thicknesses, is preferably less than about 10%, more preferably from about 1% to about 6%, and especially less than about 4%. Optical absorption modulation at such a low level is insufficient to result in electrophotographic sensitivity differences of the magnitude necessary for the generation of the plywood effect in developed prints. There may be several CGL thicknesses meeting this requirement including for example one, two or more node points where the absorption values for all the lines representing the various CTL thickness at a given CGL are closely spaced.

Any suitable computer program may be used to generate the graph showing the variation in optical absorption of the imaging member at various thicknesses of the CGL and CTL such as the program (referred herein as "FILM") described in "A Fortran Program for Analysis of Ellipsometer Measurements," Frank L. McCrackin, National Bureau of Standards Technical Note 479 (issued April 1969). The FILM computer program allows calculation of the fundamental ellipsometric parameters for a system of three films on a substrate.

The CGL thickness may be for example from about 4,000 to about 7,000 angstroms, and preferably from about 4,200 to about 6,000 angstroms. The CGL is deposited on the substrate wherein the thickness of the CGL is controlled to enable the resulting imaging member to exhibit an optical absorption modulation which is effective for substantially suppressing the optical interference effects such as the optical absorption modulation values described herein. Variation in the CGL thickness is reduced to preferably less than about 200 angstroms, and more preferably to less than about 100 angstroms. The CGL may be deposited by any conventional coating technique including for example slot coating (referred also as extrusion coating), spraying, dip coating, roll coating, wire wound rod coating, or vacuum evaporation coating. Vacuum evaporation coating is preferred since it can reduce variation in the CGL thickness to within about 1% to about 2% of the desired thickness. Conventional vacuum evaporation coating apparatus and methods are disclosed in Erhart et al., U.S. Pat. No. 3,746,502, Levchenko et al., U.S. Pat. No. 4,700,660, and Noma et al., U.S. Pat. No. 4,854,264, the disclosures of which are totally incorporated by reference.

Any suitable charge generating or photogenerating material may be employed. Typical charge generating materials include metal free phthalocyanine described in U.S. Pat. No. 3,357,989, metal phthalocyanines such as copper phthalocyanine, vanadyl phthalocyanine, bisazo compounds, quinacridones, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generating layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507. The disclosures of these patents are incorporated herein by reference in their entirety. Other charge generating materials include for example selenium containing materials such as trigonal selenium, amorphous or alloys of selenium such as selenium-arsenic, selenium-tellurium-arsenic, selenium-tellurium, and the like.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. No. 3,121,006 and 4,439,507, the disclosures of which are totally incorporated herein by reference. Organic resinous polymers may be block, random or alternating copolymers.

The CTL thickness may be for example from about 10 to about 30 microns, and preferably from about 15 to about 25 microns. The CTL may vary in thickness by up to about 1 micron, and preferably by up to about 0.1 micron. The CTL may be deposited by any conventional coating technique including for example slot coating (referred also as extrusion coating), spraying, dip coating, roll coating, wire wound rod coating, or vacuum evaporation coating.

The charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The charge transport layer not only serves to transport holes or electrons, but also protects the photoconductive layer from abrasion or chemical attack and therefore extends the operating life of the photoreceptor imaging member.

Examples of charge transporting aromatic amines for charge transport layers capable of supporting the injection of photogenerated holes of a charge generating layer and transporting the holes through the charge transport layer include triphenylmethane, bis(4-diethylamine-2methylphenyl) phenylmethane; 4'-4"-bis(diethylamino)-2',2"-dimethyltriphenyl-methane, N,N'-bis(alkylphenyl)-[1,1'-biphenyl]-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

The charge transport layer may include any suitable inactive resin binder soluble in methylene chloride or other suitable solvent. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

The preferred electrically inactive resin materials in the charge transport layer are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as LEXAN 145™ from General Electric Company; poly(4,4'-isopropylidene-diphenylene carbonate) with a molecular weight of from about 40,000 to about 45,000, available as LEXAN 141™ from the General Electric Company; a polycarbonate resin having a molecular weight of from about 50,000 to about 100,000, available as MAKROLON™ from Farbenfabricken Bayer A. G., a polycarbonate resin having a molecular weight of from about 20,000 to about 50,000 available as MERLON™ from Mobay Chemical Company and poly(4,4'-diphenyl-1,1-cyclohexane carbonate). Methylene chloride solvent is a particularly desirable component of the charge transport layer coating mixture for adequate dissolving of all the components and for its low boiling point. However, the type of solvent selected depends on the specific resin binder utilized.

If desired, the charge transport layer may comprise any suitable electrically active charge transport polymer instead of a charge transport monomer dissolved or dispersed in an electrically inactive binder. Electrically active charge transport polymer employed as charge transport layers are described, for example in U.S. Pat. Nos. 4,806,443; 4,806,444; and 4,818,650, the disclosures thereof being totally incorporated herein by reference.

The substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate may be flexible and may have any number of different configurations such as, for example, a cylinder, a sheet, a scroll, an endless flexible belt, and the like. Preferably, the substrate is in the form of an endless flexible belt and comprises a commercially available biaxially oriented polyester known as MYLAR™, available from E. I. du Pont de Nemours & Co., or MELINEX™, available from ICI Americas Inc.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The substrate may further include an electrically conductive ground plane. The ground plane may be an electrically conductive metal layer which may be formed, for example, on the substrate by any suitable coating technique, such as a vacuum evaporation depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission. Regardless of the technique employed to form the metal layer, a thin layer of metal oxide may form on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

Controlling the thickness of the CGL is a way of substantially suppressing, preferably totally suppressing, the optical interference effects at the wavelength of illumination due to the variation in thickness of the CTL. The instant method preferably is the sole way of substantially suppressing the optical interference effects. Other methods used to minimize the optical interference effects, such as providing a roughened substrate surface, providing a photosensitive layer such as the CTL or the CGL with a roughened surface, or providing an additional anti-reflection layer, may be also employed in embodiments of the instant invention.

The preferred CGL thickness may depend upon the wavelength of illumination, wherein the desired illumination wavelength provided by the laser in the electrostatographic printer/copier may be a wavelength within the range of for example 4,000 to about 8,000 angsttoms.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

The FILM computer program, described above, was rewritten to allow generation of monochromatic reflectivity as a function of film thickness for a system of two films on a substrate. Percent monochromatic optical absorption was interpreted for this system as 100% minus reflectivity. This modified FILM program allowed the simulation of the optical properties of a photosensitive imaging member comprising two layers coated on a smooth substrate since the the optical constants of the two layers and the substrate were known at the monochromatic illumination wavelength of interest.

The photoreceptor was taken to be a CGL coated on a substrate having a smooth surface via vacuum evaporation coating and a CTL extrusion coated on top of the CGL. The substrate was taken to be titanium coated polyethylene terephthalate (titanium layer thickness is 200 angstroms and the polyethylene terephthalate layer thickness is about 0.003 inch) having a refractive index of 3.325 and an absorption constant of 2.13 at the illumination wavelength of 6330 angstroms. The CGL layer was taken to be benzimidazole perylene having a refractive index of 1.87 and an absorption constant of 0.17 at the illumination wavelength of 6330 angstroms. The CGL ranged in thickness from 1,000 to 6,000 angstroms. The CTL was taken to be 50% by weight N,N'-diphenyl-N,N'-bis(3-methylphenyl)-[1,1' -biphenyl]-4,4' diamine and 50% by weight MAKROLON™ having a refractive index of 1.60 and an absorption constant of 0.00 at the illumination wavelength of 6330 angstroms. The CTL had the following thicknesses: 23.90 microns, 23.92 microns, 23.94 microns, 23.96 microns, 23.98 microns, and 24.00 microns.

Figure 2:
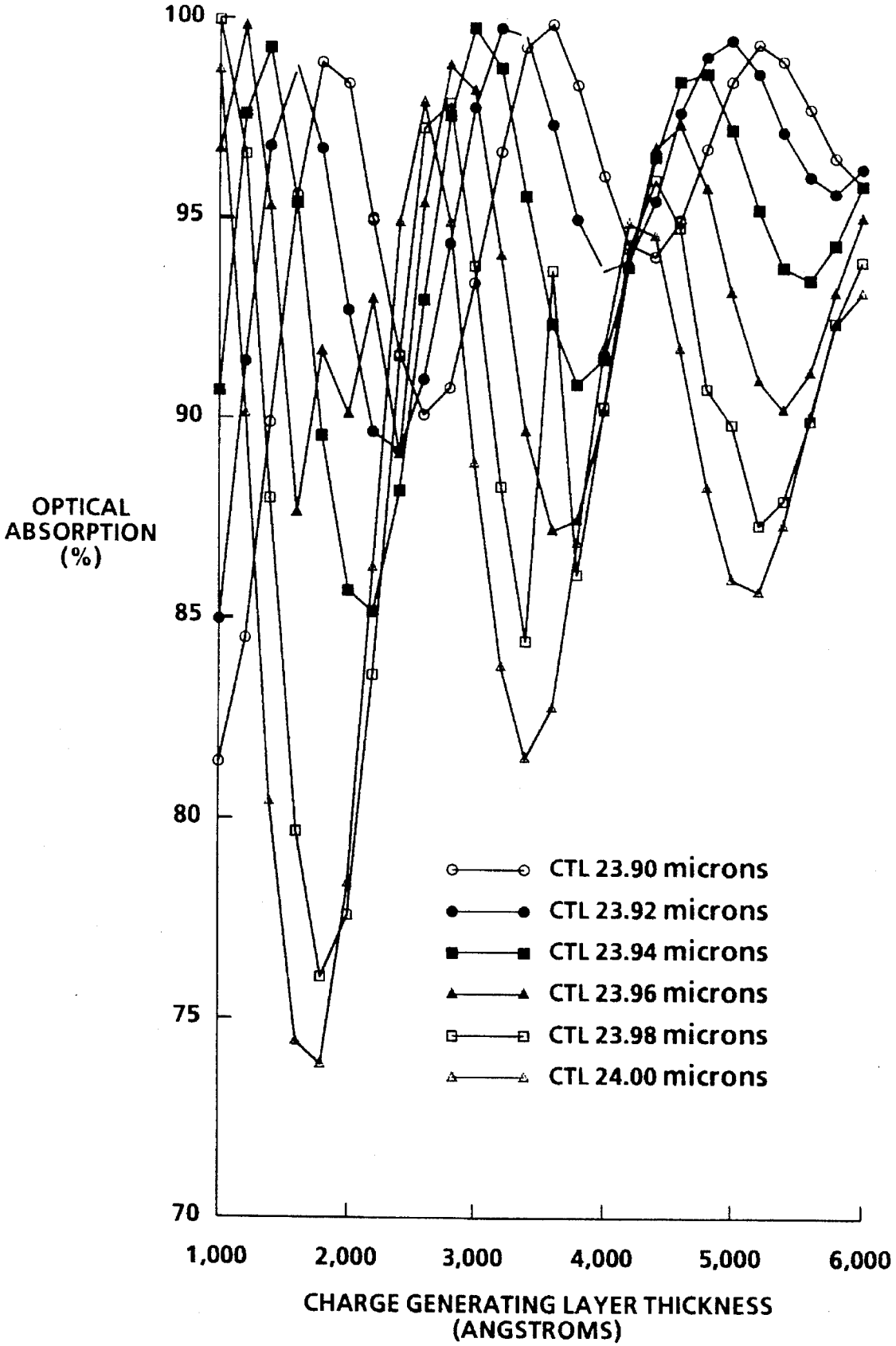
FIG. 2 is a graph of optical absorption versus charge generating layer thickness for 6 charge transport layer thicknesses for the photosensitive imaging member described in Example 1.

The photoreceptor reflectivity (percent) at 6330 angstroms at near normal (8 degrees) incidence was calculated over the entire range of CGL and CTL thicknesses described above using the modified FILM program. As seen in FIG. 2, the optical absorption (100% minus reflectivity) was plotted versus CGL thickness for the various CTL thicknesses. A node appeared in FIG. 2 at a CGL thickness of about 4,200 angstroms for which the corresponding optical absorption value was about 95% (plus or minus about 1% ) regardless of the CTL thickness. FIG. 2 suggested the existence of another node at a CGL thickness somewhat greater than about 6,000 angstroms, where the optical absorption modulation due to the variation in CTL thickness was relatively small.

Figure 3:
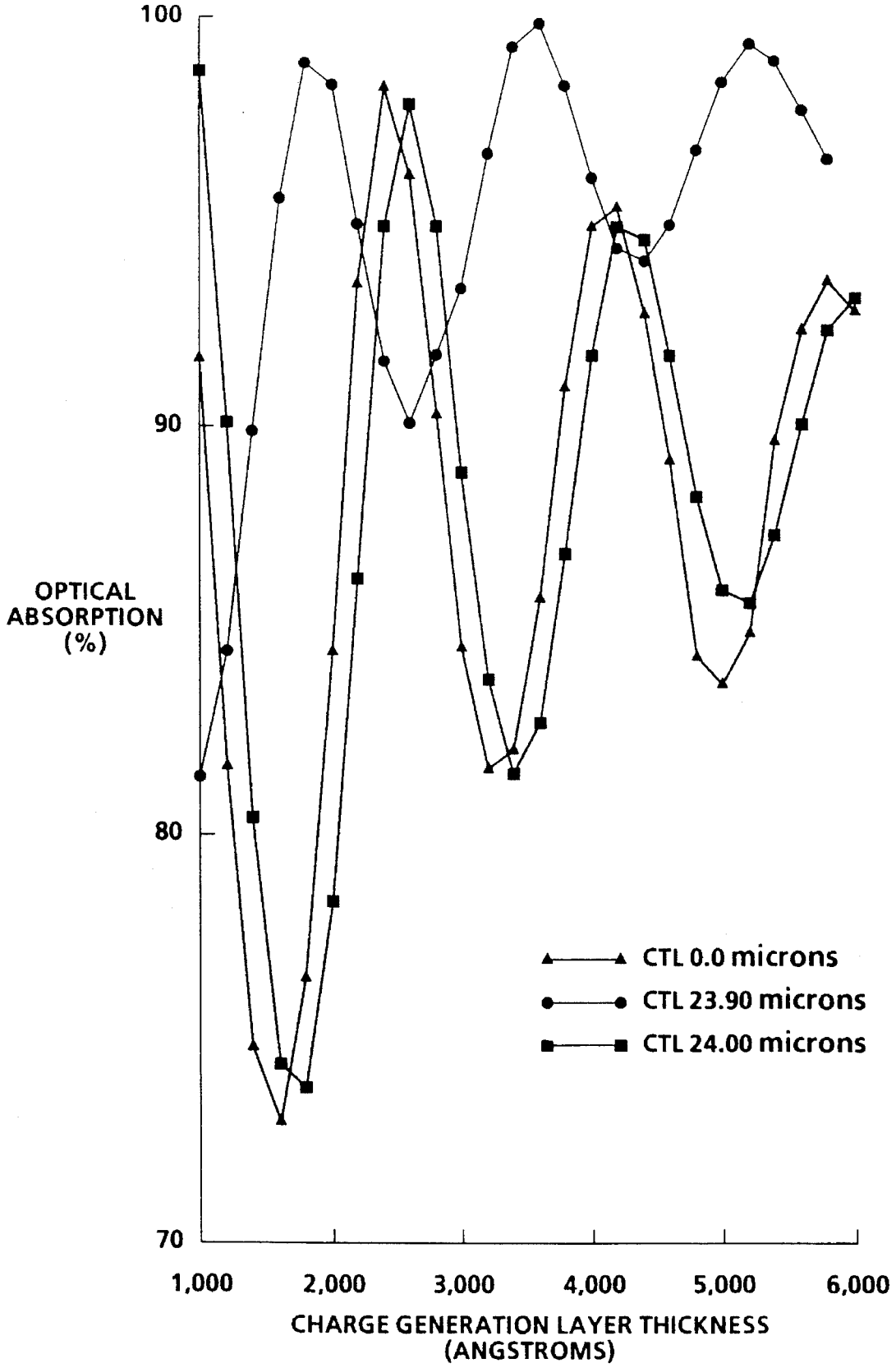
FIG. 3 is a graph of optical absorption versus charge generating layer thickness for 3 charge transport layer thicknesses for the photosensitive imaging member described in Example 1.

The optical absorption modulation curves for CTL thicknesses of 23.90 microns and 24.00 microns were reproduced in FIG. 3 together with the simulation for the CTL thickness of 0.0 (i.e., a substrate having only the CGL, but no CTL). The simulation for the CTL thickness of 0 is shown to facilitate the monitoring of the CGL thickness during its deposition by comparing the actual measured optical absorption of the photoreceptor during deposition of the CGL on the substrate with the simulated curve.

FIGS. 2–3 suggest the opportunity of controlling the CGL thickness during deposition, particularly when the CGL is deposited by vacuum evaporation coating, by following the optical absorption in situ during deposition. According to the simulation in FIG. 3 corresponding to a CTL thickness of 0.0 (i.e., a substrate having only the CGL but no CTL), as CGL deposition proceeds, the optical absorption passes through a first minimum (corresponding to a CGL thickness of about 1,600 angstroms), followed by a first maximum (corresponding to a CGL thickness of about 2,500 angstroms), then a second minimum (corresponding to a CGL thickness of about 3,300 angstroms), before reaching a second maximum (corresponding to a CGL thickness of about 4,150 angstroms) which is close to the first preferred CGL thickness of 4,200 angstroms. Controlling the CGL thickness to the desired value according to the instant invention will substantially suppress the optical interference effects since it is believed that a photosensitive member exhibiting an optical absorbance modulation of less than about 4% will show minimal or no optical interference effects.

Other modifications of the present invention may occur to those skilled in the art based upon a reading of the present disclosure and these modifications are intended to be included within the scope of the present invention.

We claim:

1. A method for forming a photosensitive imaging member to be subjected to light of a specific wavelength comprising: depositing a charge generating layer on a substrate, depositing a charge transport layer on the charge generating layer, wherein there is variation in the thickness of the transport layer, and controlling during the deposition of the charge generating layer the thickness of the generating layer as a way to substantially suppress the optical interference effects at the wavelength of illumination due to the variation in the thickness of the transport layer, wherein the thickness of the generating layer is controlled to enable the imaging member to exhibit an optical absorption modulation which is effective for substantially suppressing the optical interference effects, wherein the generating layer thickness is controlled by selecting the value of the generating layer thickness which minimizes the optical absorption modulation due to the variation in the transport layer thickness and by minimizing variation of the generating layer thickness from the selected value of the generating layer thickness.

2. The method of claim 1, wherein controlling the thickness of the charge generating layer is the sole way of substantially suppressing the optical interference effects.

3. The method of claim 1, wherein the charge transport layer varies in thickness by up to about 1 micron.

4. The method of claim 1, wherein the charge transport layer varies in thickness by up to about 0.1 micron.

5. The method of claim 1, wherein depositing the charge generating layer is accomplished by vacuum evaporation coating.

6. The method of claim 1, wherein the thickness of the generating layer is controlled to enable the imaging member to exhibit an optical absorbance modulation of less than about 10%.

7. The method of claim 1, wherein the thickness of the generating layer is controlled to enable the imaging member to exhibit an optical absorbance modulation ranging from about 1% to about 6%.

8. The method of claim 1, wherein the thickness of the generating layer is controlled to enable the imaging member to exhibit an optical absorbance modulation of less than about 4%.

9. The method of claim 1, wherein controlling the thickness of the generating layer comprises reducing variation in the generating layer to less than about 200 angsttoms.

10. The method of claim 1, wherein controlling the thickness of the generating layer comprises reducing variation in the generating layer to less than about 100 angstroms.

* * * * *